United States Patent [19]

Lundy

[11] Patent Number: 4,858,348

[45] Date of Patent: Aug. 22, 1989

[54] AUTOMATIC EJECTION SNOW PLOW

[76] Inventor: John Lundy, 3522 Creighton Rd., S.W., Atlanta, Ga. 30331

[21] Appl. No.: 203,320

[22] Filed: Jun. 2, 1988

[51] Int. Cl.[4] ..... E01H 5/02

[52] U.S. Cl. ..... 37/265; 37/130

[58] Field of Search ..... 37/265, 284, 285, 130, 37/131, 134, 135, 137, 139, 140

[56] References Cited

U.S. PATENT DOCUMENTS

| | | | |
|---|---|---|---|
| 2,026,310 | 12/1935 | Gulliver | 37/131 |
| 2,441,449 | 5/1948 | Shaw | 37/130 |
| 2,852,873 | 9/1958 | Benz | 37/130 |
| 3,107,446 | 10/1963 | Messinger | 37/130 |
| 3,121,963 | 2/1964 | Nolan | 37/130 |
| 3,310,891 | 3/1967 | Sachaczenski | 37/130 |
| 3,469,326 | 9/1969 | Malickson | 37/265 |
| 3,643,356 | 2/1972 | Gohl | 37/137 |
| 3,748,761 | 7/1973 | Chetwynde | 37/130 |
| 4,130,953 | 12/1978 | Bruno | 37/265 |
| 4,302,894 | 12/1981 | Emma | 37/130 |

*Primary Examiner*—Eugene H. Eickholt
*Attorney, Agent, or Firm*—Needle & Rosenberg

[57] ABSTRACT

A manually operated snow plow has a frame which is mounted on a wheel and axle assembly so that it can be pushed along the ground. A snow scoop is rotatably mounted within a pan which is positioned just above the ground surface and securely connected to the front of the frame. The scoop is spring powered so that when the scoop has collected a load of snow the scoop can eject the snow (in a flipping motion) to the side of the area being cleared. A latch retains the scoop in position within the pan and against the spring tension. Manual release of the latch by means of a simple cable connection thus activates the spring mechanism of the scoop to eject the snow. After the scoop has ejected the snow, a handle positioned at the rear of the frame allows manual retraction of the scoop into the pan thereby bringing the scoop into a position where it can receive another snow load and simultaneously loading the spring mechanism.

10 Claims, 3 Drawing Sheets

AUTOMATIC EJECTION SNOW PLOW

BACKGROUND OF THE INVENTION

The invention relates to a snow plow or snow shovelling apparatus and more particularly to an unmotorized manually operated apparatus which allows the lifting and discharging of snow therefrom with minimal physical exertion on the part of the user.

As is well known, the repeated bending over and lifting necessitated by the normal snow shovelling operation puts considerable strain on the spine, ligaments and muscles associated therewith. For this reason, shovelling of snow from a person's sidewalks can result in back aches, back muscle strains and sprains and generally the generally be an unpleasant experience. In addition, the leverage involved in holding a heavy load of snow at a distance from the shoveller's torso can put guite a burden on the heart muscle as well as the back generally. Thus, the activity of shovelling snow can be very heavy exertion for a person who may already be tired after having put in a full day's work and can therefore be very exhausting as well as subject the shoveller to a very real risk of injury to the heart, back or other parts of the body.

Prior art devices for shovelling snow characteristically incorporate some type of leverage to allow manual lifting of snow and/or flipping of snow from the device. Some of these devices require the user to twist or turn a handle in order to rotate the snow scoop and flip the snow from the scoop. An example of such a device is disclosed in U.S. Pat. No. 2,441,449 to Shaw. The Shaw device requires that the user bear down on the handle with his weight thereon in order to lift the snow carried in the scoop. The handle and scoop are mounted on a frame which pivots on a fulcrum structure (based on the wheel axis) during this lifting operation. The handles are turned about a second axis disposed intermediate the wheels to dump the snow to a side of the device by a sort of flipping action. The primary disadvantage with this prior art device is that the entire lifting and flipping operation requires substantial physical exertion on the part of the user. Moreover, in order to flip the snow a substantial distance from the sidewalk and thereby ensure that the snow does not pile up adjacent the sidewalk where it can slide thereunto later (requiring the user to clear the same area over again), the user must put more power into the flipping motion in order to increase the flipping speed and thereby "throw" the snow a greater distance. Thus, the heavy physical exertion involved in the use of such a prior art device may also result in the same type and severity of injury as less highly leveraged shovelling devices such as a regular snow shovel.

Another prior art device, disclosed in U.S. Pat. No. 2,720,043 to Chamberlin, for shovelling snow from walkways uses a complicated set of levers and oscillating rods linked to a snow scoop and a handle. Pushing down on a handle tilts the scoop and throws the snow from the scoop. However, due to the complex linkage system much of the user's energy expended in tilting the scoop by moving the handle is wasted because of binding of the linkage and frictional losses. Therefore, it is very difficult for the user to "throw" the snow a very long distance. Thus, as with the previous prior art device, the Chamberlin device cannot put the snow a sufficient distance from the walkway to in effect clear the walkway and does not siginificantly reduce the amouunt of physical energy required of the user. In addition, the complexity of such systems makes them more trouble prone and inefficient.

Other prior art snow plow devices use both leverage and body weight to shovel the snow. An example of such a plow is disclosed in U.S. Pat. No. 3,107,446 to Messinger. In this prior art plow, the handle is adjustable in order to accommodate the height of the user and to add more leverage to move a greater quantity of snow. The scoop is balanced on an axis so that when the scoop is filled with snow and unlatched from its rear attachment to the frame, the weight of the snow causes the scoop to tilt and dump the snow. However, the scoop must be moved to a place where the snow is to be dumped because the device has no capability of "throwing" the snow load. Thus, the device requires the user to expend a lot of energy in order to move the device around. In addition, the device requires the user to have a certain degree of strength and to expend considerable energy to lift the snow. Thus, use of the device involves considerable physical exertion and the user is consequently subject to the same risks of physical injury as with the use of the prior art devices previously discussed.

Powered prior art devices relieve the user of the physical exertion otherwise required to shovel snow from a walkway. These devices which include snow blowers and motorized snow plows require the same relatively high maintenace as other motorized vehicles and equipment. Additionally, such motorized devices may be very troublesome in that they may be very difficult to start after months of disuse. Moreover, many motorized devices are typically hard to start in cold weather. Fuel costs added to the maintenance costs and troublesome operation may not outweigh the saving in physical work such devices provide. Consequently, although such motorized prior art devices provide desired benefits, they have many disadvantages precluding them from having widespread appeal to members of the public which have a need for snow plows.

Thus, a snow plow is needed that has low maintenance costs, is energy efficient, and can eject snow well away from the walkway in order to properly clear the walkway. Moreover, a snow plow is needed that has such attributes while being capable of plowing snow with a minimum of physical exertion required from the user.

SUMMARY OF THE INVENTION

It is a principal object of the present invention to provide a snow plow which can clear snow from an area with minimal physical exertion required of the user.

It is another object of the invention to provide a snow plow which can eject snow a significant distance from the area being cleared of snow.

It is another object of the invention to provide a snow plow which can automatically eject snow from the area being cleared of snow.

It is another object of the invention to provide a snow plow which is capable of handling large loads.

It is still another object of the invention to provide a snow plow which requires minimal maintenance.

It is another object of the invention to provide a snow plow which is manually operable.

It is another object of the invention to provide a snow plow which is inexpensive to operate and maintain.

It is yet another object of the invention to provide a snow plow which is inexpensive to manufacture.

The apparatus of the present invention is specifically designed to automatically eject snow from a snow scoop upon manual activation of a spring loaded ejection system which is incorporated therein. An important feature of the invention is that the ejection is accomplished without any significant physical exertion on the part of the user and without the use of a motor. In addition, the snow is ejected a sufficient distance from the pathway to keep the pathway clear of the snow which has been removed therefrom.

Generally, the invention has a pair of wheels and an axle mounted on a frame. The frame also supports a base pan within which is positioned a scoop for containing the snow load. A handle on the frame allows the device to be pushed along a pathway and the scoop to be pushed under a quantity of snow to be cleared from the pathway.

Once the scoop is filled with a desired quantity of snow, the user pulls a cable or rope which unlatches the scoop from one end of the pan. This action also activates a spring system to rotate the scoop about an axis at the other end of the pan, thereby "flipping" the snow off the scoop and over the axis side of the pan.

The pan has openings at the axis side thereof to accommodate the free ends of the springs so that the ends abut the scoop. The spring tension thus exerts a force directly on the scoop to rotate it about its axis to thereby eject the snow therefrom.

After the snow has been ejected from the scoop, the user pushes a scoop retraction handle mounted on the rear portion of the frame to retract the scoop into the pan. The latch automatically locks the scoop within the pan to both retain the scoop in the pan and to keep the springs loaded in preparation for the next ejection sequence. Thus, the only significant physical exertion required of the user is that required to pull the rope releasing the latch and push the scoop back into position within the pan after the ejection sequence. The spring system does substantially all the work required to both lift the snow and eject it from the pathway area.

The scoop retraction handle is attached to the frame by link arms which enable the handle to move to a limited degree in both the up and down and front and back directions. The handle is connected to a yoke which holds an axle and wheel generally riding on tracks mounted on the front portion of the frame so that the wheel can move up and down relative to the frame. The wheel axle is connected to a rider which engages a scoop arm. In operation, pushing the scoop retraction handle forward moves the wheel and rider down and thereby moves the scoop arm down retracting the scoop down into the pan. Moving the scoop retraction handle forward also moves the scoop against the tension of the spring thereby loading the springs. Also, pulling the scoop retraction handle backwards moves the wheel and rider up thereby clearing the way for the scoop arm to move up simultaneously with the scoop pan when the scoop pan is released. This makes the scoop ready for another load of snow.

From the foregoing, it is evident that the user does not have to bend over or twist or turn his body in order to perform the show shovelling operation when using the instant invention. The mechanics of the invention are not unduly complex and the spring system which lifts and flips the load is relatively simple; it is therefore reliable and requires minimal maintenance. Thus, use of the present invention significantly reduces the risk of serious physical injury generally involved in the act of shovelling snow and does so without adding unnecessary expenses of fuel costs, maintenance costs and without the unreliability of prior art motorized snow plows.

DETAILED DESCRIPTION OF THE PREFERRED EMBODIMENT

Figure 1:
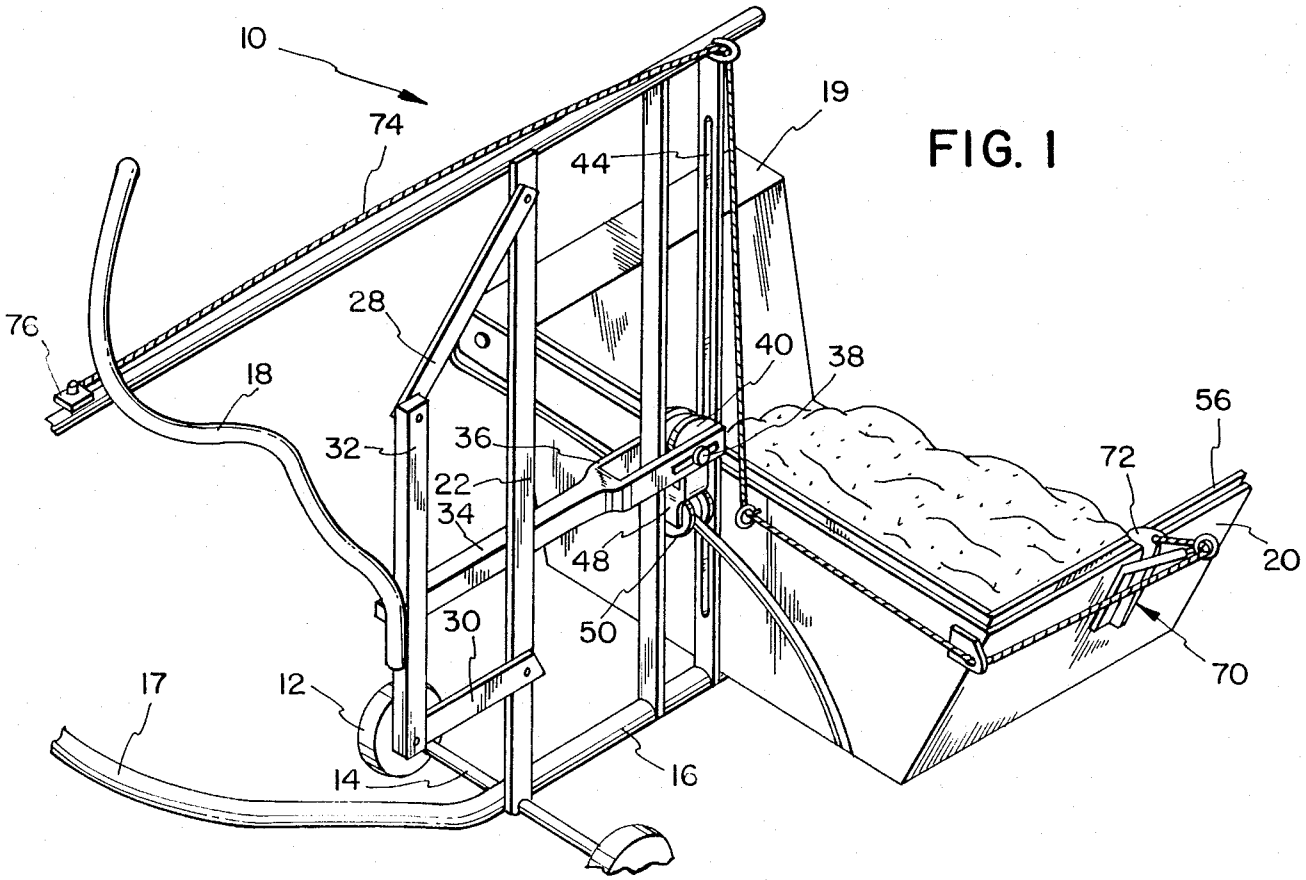
FIG. 1 is a perspective view of the invention showing the scoop containing a load of snow.
Figure 2:
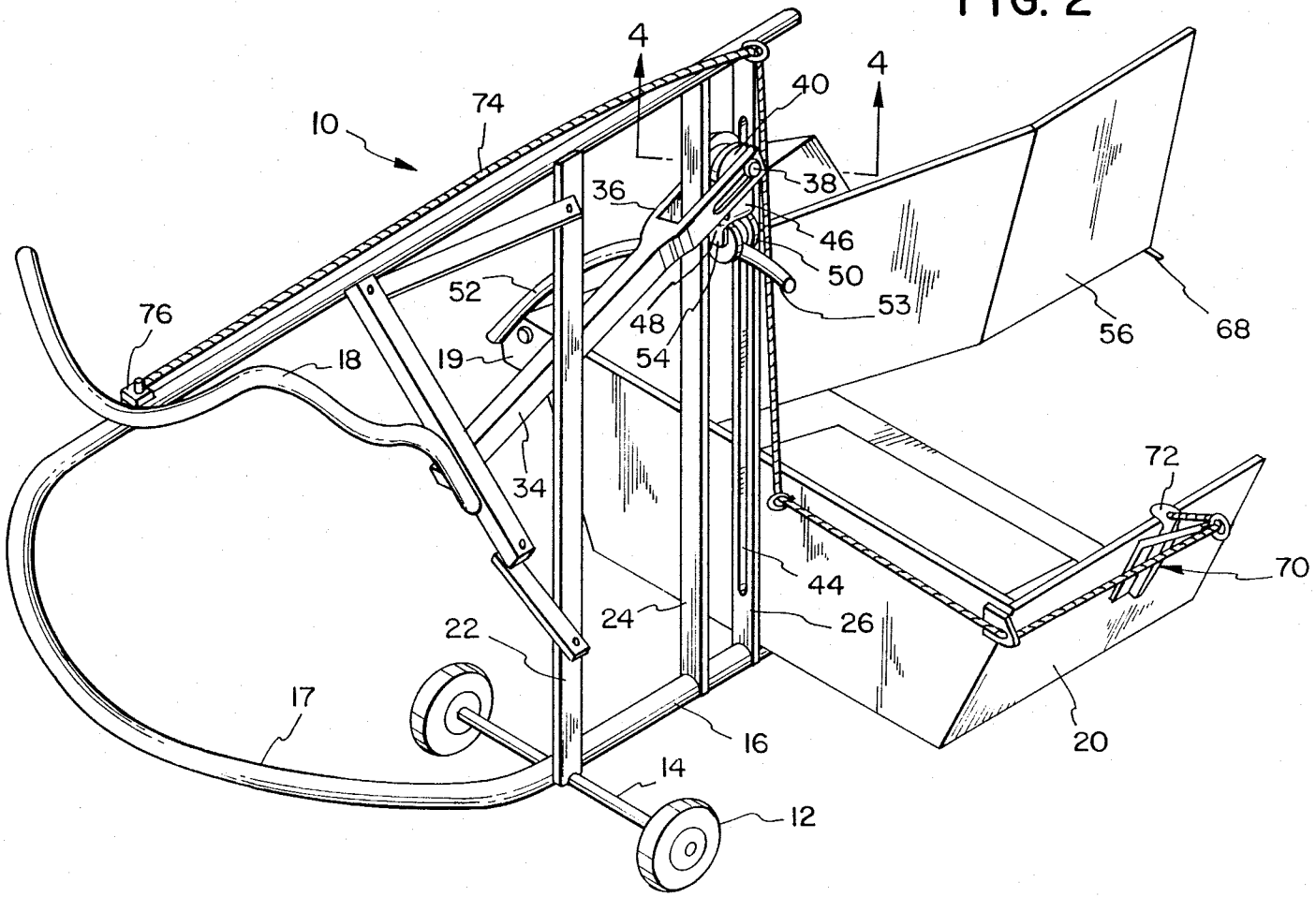
FIG. 2 is a perspective view of the invention showing the scoop in a fully raised position after having ejected a load of snow.

Referring to FIGS. 1 and 2, the snow plow of the present invention is generally designated by the numeral 10. A pair of wheels 12 of any suitable type are mounted on the axle 14. Axle 14 is connected to a frame 16 preferably at a lower portion thereof. The frame 16 is curved into a generally U-shape so as to form a handle 17 at a rear portion of the frame to allow the plow 10 to be pushed along a ground surface. Alternatively, handle 17 may instead be a separate structure which is connected to the frame 16 at a suitable location. A lower front portion of the frame is connected to a pan 20 which is positioned so that it is generally adjacent to the ground surface. The pan 20 is preferably securely connected to the frame 16 so that the pan/frame structure is strong enough to withstand being pushed into large snow enbankments or accidentally pushed into curbs, cracks in sidewalks and the like.

Figure 4:
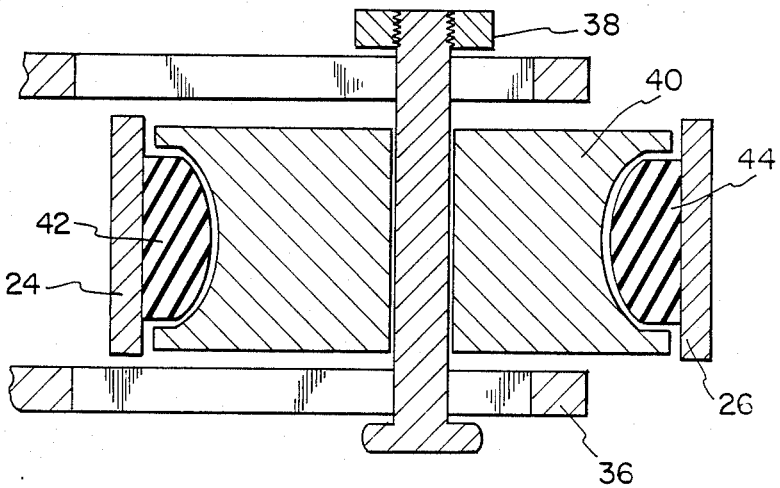
FIG. 4 is cross sectional view of the scoop wheel and associated structures of the invention taken along the lines 4—4 in FIG. 2.

Vertical members 22, 24, and 26 connect the middle and end portions of the frame 16 together. Link arms 28 and 30 are connected to one end of each to member 22. The other ends of link arms 28 and 30 are connected to link arm 32 at its ends. Handle 18 is also rigidly connected to link arm 32 as is yoke arm 34, preferably at a lateral portion thereof, as shown. The connections of link arms 28 and 30 to the frame 16 and the connections of link arm 32 to link arms 28 and 30 allow a limited degree of movement of handle 18 and yoke arm 34 in the vertical and forward and backward directions. Yoke arm 34 is rigidly connected at an end thereof to yoke 36. Yoke 36 has a slotted aperture in both front forked ends thereof for allowing slidable movement of axle 38 therein generally longitudinally with respect to arm 34, as shown in FIGS. 1, 2, and 4. Axle 38 holds wheel 40 which moves up and down between vertical members 24 and 26 on a set of tracks 42 and 44 (or simply a single track) mounted on inner surfaces of members 24 and 26. There is preferably sufficient clearance between wheel 40 and tracks 42 and 44 to allow wheel 40 to cock to the front or back when moved up or down so that it rolls on one of the tracks 42 and 44 to prevent jamming of the wheel 40 yet also keep wheel 40 generally on the tracks 42 and 44.

A stabilizer 46 is connected to the axle 38 for stabilizing and guiding the movement of wheel 40 on tracks 42 and 44. Stabilizer 46 has preferably a pair of runners 48 at preferably a lower portion thereof which slide on tracks 42 and 44. There is also sufficient clearance between runners 48 and tracks 42 and 44 to allow cocking of the wheel 40 as set forth hereinabove. Thus, stabilizer 46 by means of its connection to axle 38 and its use of runners 48 ensure that wheel 40 moves only in the plane of tracks 42 and 44. Stabilizer 46 also includes a rider, preferably in the form of a roller 50 mounted preferably at a lower portion of the stabilizer 46 which engages a scoop lever 52 preferably at an end thereof. The axis 54 of roller 50 is situated so that it allows lateral movement (relative to frame 16) of the end 53 of scoop lever 52 against the roller 50 for reasons which will be discussed below. Scoop lever 52 is rigidly connected to scoop 56 which is rotatably connected to one lateral end 19 of pan 20 as shown. Thus, rotational movement of scoop lever 52 rotates scoop 56 about the end of pan 20. Therefore, movement of handle 18 forward moves yoke 36 down which in turn moves wheel 40 and roller 50 down. Since roller 50 rides on lever 52, downward movement of roller 50 moved end 53 of lever 52 down resulting in rotation of lever 52 and scoop 56 about the end of pan 20 to which it is connected.

Figure 3:
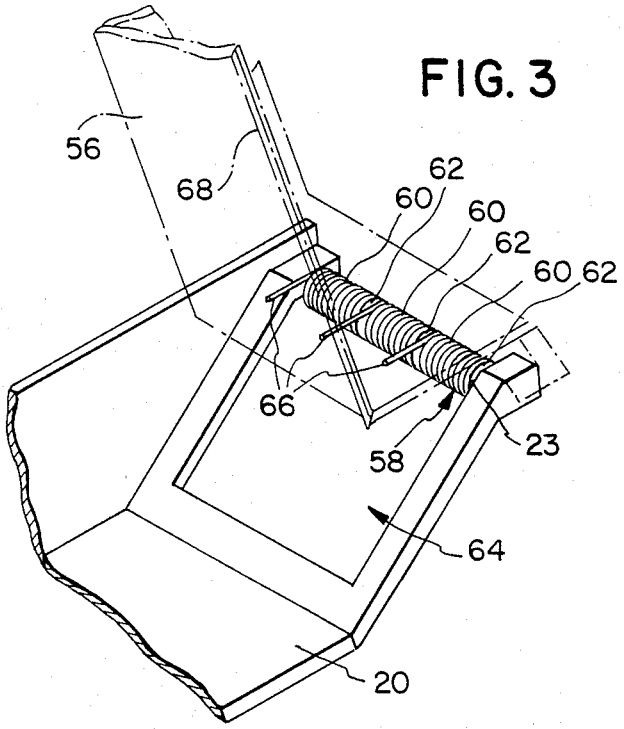
FIG. 3 is a perspective view of a portion of the invention showing the spring system in more detail, as well as a portion of the pan and scoop.

In order to accomplish automatic rotation of scoop 56 to flip a load of snow off to the side of the plow 10, a spring mechanism 58 is mounted on pan 20. Spring mechanism 58 preferably includes a coil spring 60 one end 62 of which is anchored to pan 20 at preferrably end 19 thereof (preferably by connection to shaft 23 mounted to pan 20 at end 19). Pan 20 preferably has a recess 64 (shown in FIG. 3) which allows movement of the free ends 66 of spring 60 therethrough. Recess 64 allows free ends 66 of spring 60 to abut a side of scoop 56 so that the tension of spring 60 exerts a force on scoop 56 to rotate it about its axis at end 19 of pan 20 to thereby eject a load of snow off to the side of snow plow 10 (and off to the side of the pathway to be cleared). Instead of a spring mechanism, mechanism 58 may be any suitable power device which can exert a force on the side of scoop 56 to power the rotation of scoop 56, and which can be loaded by retraction of the scoop 56 by handle 18, as described.

Scoop 56 is approximately dimensionally commensurate with pan 20 so that scoop 56 can generally fit within pan 20. Scoop 56 is also preferably open at its top side and front side so that it can receive snow from its front and dump the snow out of its top. Scoop 56 preferably also has a generally downwardly and forwardly extending lip 68 preferably at the front edge of its bottom side so that the lip 68 can be pushed underneath the snow at the ground surface to scrape the snow layer off the ground surface. Thus, lip 68 is positioned to be in contact with the ground surface or proximal to the ground surface.

A latch 70 is mounted on the pan 20 preferably at a lateral side of the pan 20 opposite that at which scoop 56 is rotatably mounted. Latch 70 has a hook 72 which covers an upper edge of a lateral side of the scoop 56 to hold scoop 56 in a desired position within the pan 20. Latch hook 72 also holds scoop 56 in a retracted position within pan 20 so that spring 60 is loaded ready to rotate scoop 56 over the side of the plow 10. Latch 70 and hook 72 are preferably stainless steel or another material having sufficient strength to withstand the force exerted by the spring against the hook 72. Hook 72 is preferably held in position over the upper edge of the scoop by means of a spring (not shown) which pulls the upper end of the hook 72 inwardly toward the opposite side of the pan 20. Instead of being connected to pan 20, latch 70 may be connected to the frame 16; alternatively, the pan 20 may simply be a part of, or unitary, with the frame 16.

A rope, or cable 74 is connected to the upper end of the hook 72 allowing the hook to be pulled away from the upper end of the scoop 56 to allow the activation of spring mechanism 58 to rotate the scoop and flip the snow load over to the side of the snow plow 10. The rope handle 76 or rope 74 is therefore positioned proximal the handle end of the frame to allow the user easy access thereto.

In operation, the user pushes on the handle 18 to move the snow plow 10 into the snow layer to be plowed and fill scoop 56 with snow. Once the scoop 56 has a desired load of snow therein, the user pulls the rope handle 76 which releases the latch 70 and also activates the spring mechanism 58 to rotate the scoop 56 and consequently eject or "flip" the snow load over the side of the plow 10 and well to the side of the pathway which is being cleared. Ejecting the snow a substantial distance from the plow helps to ensure that the snow plowed does not merely fall onto an embankment adjacent the pathway and build up there, only to subsequently slide back onto the pathway again.

After the plow 10 has ejected the snow from the scoop 56, the user pushes the handle 18 forward which pushes the wheel 40, stabilizer 46 and roller 50 downto rotate scoop lever 52 and scoop 56 in order to move scoop 56 into a retracted position within the pan 20. Once retracted, latch 70 locks scoop 56 into position within the pan 20. Simultaneously, pushing the handle 18 also pushes the spring end 66 (which abuts scoop 56) against the spring tension to load the spring mechanism 58. Subsequently, backward movement of handle 18 raises yoke arm 34, yoke 36, and parts 38, 40, 46, 48 and 50 up to provide sufficient space between track parts 42 and 44 to allow scoop arm 52 and its end 53 to swing up freely and simultaneously with scoop 56 in the flipping of a new load of snow when scoop 56 is released from the hold of latch 70 and hook 72 by pulling rope handle 76 backward. Thus, the user of the plow 10 of the instant invention is not required to bend over, twist his torso, or do any lifting in order to shovel snow from a pathway or other suitable area. Because of the easy and more effortless operation of the snow plow 10, there is reduced risk of overexertion with its concomitant risks of heart, back or other type of muscle, joint or ligament injury.

Although it is preferred that the snow plow 10 be composed of aluminum and stainless steel (scoop handle 18, arm 32, yoke arm 34) for strength, durability and rust resistance to survive salted pathways and roadways, the plow may also be composed of any metal, plastic, wood, or other suitable material, or any combination thereof.

Accordingly, there has been provided, in accordance with the invention, a snow plow for removal of snow from a pathway or other suitable area that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosures set forth herein. Accordingly, it is intended to include all such alternatives, embodiments, modifications, and variations that fall within the spirit and the scope of the invention as set forth in the claims hereinbelow.

I claim:

1. A snow plow, comprising:

a frame;

a scoop for receiving and containing a load of snow therein said scoop rotatably connected to said frame;

means for ejecting snow out of said scoop, said means for ejecting operably connected to said scoop and comprising a power mechanism connected to said scoop for forcibly rotating said scoop in order to eject snow from said scoop;

means for manually activating said power mechanism;

means for rotating said scoop into a desired position adjacent the ground surface to receive a load of snow therefrom; and a latch engaging said scoop to retain said scoop in the desired position adjacent the ground surface; and running gear connected to said frame, said running gear enabling said scoop to be moved over a ground surface, said means for moving comprising;

a yoke;

a wheel having an axle mounted within said yoke;

a set of tracks mounted on said frame, said wheel engaging said set of tracks for generally vertical movement of said wheel along said set of tracks;

a handle rigidly connected to said yoke for moving said wheel along said set of tracks;

means for movably connecting said handle to said frame;

a stabilizer connected to the axle of said wheel, said stabilizer having runners slidably engaging said set of tracks to ensure said wheel moves generally only in a plane defined by said set of tracks;

a roller rotably mounted on said stabilizer; and a scoop lever rigidly connected to said scoop, said scoop lever movably engaging said roller so that movement of said wheel down rotates said lever down to rotate said scoop down into the desired position adjacent the ground surface.

2. The snow plow of claim 1 wherein said means for activating includes a cable connected to said latch to manually release said scoop from retention in the desired position adjacent the ground surface.

3. The snow plow of claim 1 wherein said power mechanism includes a spring.

4. A snow plow, comprising:

a frame having a handle at a rear portion thereof;

running gear mounted on said frame at a lower portion thereof, said running gear enabling said frame to be moved along a ground surface;

a pan connected to said frame at lower front portion thereof;

a scoop for receiving and containing a load of snow therein, said scoop rotatably connected to said pan at a lateral portion thereof;

means for rotating said scoop relative to said pan about an axis located at a lateral portion of said pan in order to eject the load of snow from said scoop;

means for activating said means for rotating;

means for retaining said scoop in a desired position within said pan;

means for moving said scoop into a desired position within said pan.

5. The snow plow of claim 4 wherein said means for forcibly rotating includes a spring connected to said pan, said spring anchored to said pan, said spring having a free end abutting a lateral surface of said scoop so that the spring tension can exert a force against the lateral surface of said scoop in order to rotate the scoop relative to said pan.

6. The snow plow of claim 7 wherein said means for retaining said scoop includes a latch mounted on a lateral surface of said pan and engaging a portion of said scoop in order to retain said scoop in the desired position within said pan.

7. The snow plow of claim 6 wherein said means for activating said means for rotating includes a cable operably connected to said latch, said cable being manually operable to release the latch allowing the force exerted by said spring to rotate said scoop.

8. The snow plow of claim 4 wherein said means for moving said scoop into a desired position includes:

a yoke;

a wheel having an axle mounted within said yoke;

a set of tracks mounted on said frame, said wheel engaging said set of tracks for generally vertical movement of said wheel along said set of tracks;

a handle rigidly connected to said yoke for moving said wheel along said set of tracks;

means for movably connecting said handle to said frame;

a stabilizer connected to the axle of said wheel, said stabilizer having runners slidably engaging said set of tracks to ensure movement of said wheel generally along at least one of said set of tracks;

a roller rotatably mounted on said stabilizer;

a scoop lever rigidly connected to said scoop, said scoop lever movably engaging said roller so that movement of said wheel down rotates said scoop lever down to rotate said scoop down into a desired retracted position within said pan.

9. The snow plow of claim 4 wherein said running gear includes an axle and at least one wheel rotatably mounted on said axle.

10. The snow plow of claim 4 further including a lip connected to said scoop at a front edge thereof, said lip adapted to be adjacent the ground surface to allow said scoop to generally scrape snow off the ground surface.

* * * * *